US007374850B2

(12) United States Patent
Pattison et al.

(10) Patent No.: US 7,374,850 B2
(45) Date of Patent: May 20, 2008

(54) COATED CARRIERS

(75) Inventors: Christopher M. Pattison, Rochester, NY (US); Thomas C. Dombroski, Rochester, NY (US); Deepak R. Maniar, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 405 days.

(21) Appl. No.: 11/117,964

(22) Filed: Apr. 29, 2005

(65) Prior Publication Data

US 2006/0246369 A1 Nov. 2, 2006

(51) Int. Cl.
*G03G 9/113* (2006.01)

(52) U.S. Cl. ..... 430/111.35; 430/137.13

(58) Field of Classification Search ..... 430/111.35, 430/137.13

See application file for complete search history.

(56) References Cited

U.S. PATENT DOCUMENTS

| | | | | |
|---|---|---|---|---|
| 4,233,387 | A | 11/1980 | Mammino et al. | |
| 4,546,060 | A | 10/1985 | Miskin et al. | |
| 5,236,629 | A | 8/1993 | Mahabadi et al. | |
| 5,246,809 | A * | 9/1993 | Funato et al. | 430/105 |
| 5,935,750 | A | 8/1999 | Barbetta et al. | |
| 5,945,244 | A | 8/1999 | Barbetta et al. | |
| 5,998,076 | A * | 12/1999 | Mahabadi et al. | 430/111.32 |
| 6,004,712 | A | 12/1999 | Barbetta et al. | |
| 6,010,812 | A | 1/2000 | Barbetta et al. | |
| 6,042,981 | A | 3/2000 | Barbetta et al. | |
| 6,528,225 | B1 | 3/2003 | Mahabadi et al. | |
| 6,660,444 | B2 * | 12/2003 | Mahabadi et al. | 430/137.13 |
| 2004/0248015 | A1 * | 12/2004 | Kamikoriyama et al. | 430/4 |

* cited by examiner

*Primary Examiner*—John L Goodrow
(74) *Attorney, Agent, or Firm*—E. O. Palazzo

(57) ABSTRACT

Carrier comprised of a core, a polymer coating, and wherein said coating contains a mixture of an alkali metal lauryl sulfate and a conductive component.

8 Claims, No Drawings

COATED CARRIERS

RELATED APPLICATIONS AND PATENTS

Illustrated in U.S. Pat. Nos. 6,528,225, and 5,998,076, the disclosures of which are totally incorporated herein by reference, is, for example, a carrier comprised of a soft or hard magnetic core, a number of, or all of the pores thereof being filled with polymer and thereover a coating and a carrier comprised of a porous hard magnetic core, and wherein the pores thereof are filled with a polymer, and which carrier contains a coating thereover of a polymer, or a polymer mixture.

Illustrated in U.S. Pat. No. 6,004,712, the disclosure of which is totally incorporated herein by reference, is, for example, a carrier comprised of a core, and thereover a polymer of (1) methylmethacrylate and a monoalkyl aminoalkyl methacrylate, or (2) a polymer of methylmethacrylate and dialkylaminoalkyl methacrylate.

Illustrated in U.S. Pat. Nos. 5,945,244, 6,042,981, 6,010,812, and 5,935,750, the disclosures of each of which are totally incorporated herein by reference, are carrier particles comprised, for example, of a core with coating thereover of polystyrene/olefin/dialkylaminoalkyl methacrylate, polystyrene/methacrylate/dialkylaminoalkyl methacrylate, and polystyrene/dialkylaminoalkyl methacrylate. More specifically, there is illustrated in U.S. Pat. No. 5,945,244, the disclosure of which is totally incorporated herein by reference, a carrier comprised of a core, and thereover a polymer of styrene, an olefin and a dialkylaminoalkyl methacrylate; in U.S. Pat. No. 6,042,981, the disclosure of which is totally incorporated herein by reference, is illustrated a carrier composition comprised of a core and thereover a polymer of (1) polystyrene/alkyl methacrylate/dialkylaminoethyl methacrylate, (2) polystyrene/alkyl methacrylate/alkyl hydrogen aminoethyl methacrylate, (3) polystyrene/alkyl acrylate/dialkylaminoethyl methacrylate, or (4) polystyrene/alkyl acrylate/alkyl hydrogen aminoethyl methacrylate; U.S. Pat. No. 6,010,812, the disclosure of which is totally incorporated herein by reference, is illustrated a carrier comprised of a core and a polymer coating of (1) styrene/monoalkylaminoalkyl methacrylate or (2) styrene/dialkyl aminoalkyl methacrylate; and in U.S. Pat. No. 5,935,750, the disclosure of which is totally incorporated herein by reference, is illustrated a carrier comprised of a core and a polymer coating containing a quaternary ammonium salt functionality.

In U.S. application Ser. No. 10/658,874, Publication No. 20050064194, the disclosure of which is totally incorporated herein by reference, is illustrated a carrier comprised of a core, a polymer coating, and wherein said coating contains a conductive polypyrrole contained in a carbon black matrix; or a polyaniline contained in a carbon black matrix.

The appropriate components of the copending applications may be selected for the disclosures illustrated herein in embodiments thereof.

BACKGROUND

There are generally disclosed developer compositions, and more specifically, developer compositions containing carriers. In embodiments, the carrier particles can be comprised of a core, a polymer, or mixture of polymer coatings thereover, and which coating or coatings have incorporated therein a conductive component, such as a conductive carbon black, and an alkali metal sulfate, such as a sodium lauryl sulfate, and wherein the resulting carriers are conductive, for example a carrier conductivity of from about $10^{-6}$ to about $10^{-12}$ ohm-cm$^{-1}$. The carriers may be mixed with a toner of resin, colorant, and optional toner additives to provide developers that can be selected for the development of images in electrostatographic, especially xerographic imaging systems, printing processes and digital systems, including color processes.

Advantages of the carriers in embodiments illustrated herein include, for example, enabling carriers with high conductivities, such as from about $10^{-4}$ to about $10^{-15}$, and more specifically, from about $10^{-6}$ to about $10^{-8}$; tunable triboelectric charges, that is where such charges can be preselected; low economical coating weights, such as for example, from about 0.005 percent to about 1 percent, and more specifically, from about 0.05 to about 0.5 percent, and which weights permit excellent carrier surface coverage; low conductive component amounts, such as from about 0 to about 20, and more specifically, from about 1 to about 10; maintaining the carrier triboelectric charge at from about 18 to about 25 microcoulombs per gram and a conductivity of from about $10^{-8}$ to about $10^{-6}$ (1 ohm-cm) at, for example, a 10 volt potential across a 0.1 inch gap containing carrier beads held in place by a magnet; and wherein the carrier particles are of a triboelectric charging value of from about 15 to about 65 microcoulombs per gram, and more specifically, from about 15 to about 25 microcoulombs per gram as determined by a Faraday Cage, these parameters being dependent, for example, on the carrier coatings selected, and the percentage of each of the polymers present, and the conductive polymer; and wherein the carriers can be mixed with toners, including magnetic or MICR toners.

REFERENCES

Developer compositions with coated carriers that contain conductive components like carbon black are known. Disadvantages associated with these known carriers may be that the carbon black can increase the brittleness of the polymer matrix, which causes the separation of the coating from the core, and thereby contaminates the toner and developer causing, for example, instabilities in the charging level of the developer as a function of factors, such as the developer age in the xerographic housing and the average toner area coverage of a printed page, or instabilities in the color gamut of the developer set. In addition, with carbon black it is difficult to tune, or preselect the carrier conductivity. These and other disadvantages are avoided, or minimized with the carriers illustrated herein in embodiments thereof.

The conductivity of carbon blacks is generally independent of the type of carbon black used, and in composites, there is usually formed a filamentary network above a certain concentration referred to as the "percolation" threshold. At concentrations of up to about 30 weight percent, conductivities of $10^{-2}$ (ohm-cm)$^{-1}$ have been reported. The resistivity thereof, measured with a standard 4-pin method according to ASTM-257, is observed to increase with decreasing carbon black concentration.

Carrier particles for use in the development of electrostatic latent images are illustrated in many patents including, for example U.S. Pat. No. 3,590,000. These carrier particles may contain various cores, including steel, with a coating thereover of fluoropolymers, or terpolymers of styrene, methacrylate, and silane compounds. Recent efforts have focused on the attainment of coatings for carrier particles for the purpose of improving development quality; and also to permit carrier particles that can be recycled, and which do not adversely effect the imaging member in any substantial manner. Some of the present commercial coatings can deteriorate, especially when selected for a continuous xerographic process where the entire coating may separate from the carrier core in the form of chips or flakes, and fail upon impact, or abrasive contact with machine parts and other carrier particles. These flakes or chips, which are not generally reclaimed from the developer mixture, have an adverse effect on the triboelectric charging characteristics of the carrier particles thereby providing images with lower resolution in comparison to those compositions wherein entire carrier coatings are retained on the surface of the core substrate. Further, another problem encountered with some prior art carrier coatings resides in fluctuating triboelectric charging characteristics, particularly with changes in relative humidity. The aforementioned modification in triboelectric charging characteristics provides developed images of lower quality, and with background deposits.

There is illustrated in U.S. Pat. No. 4,233,387, the disclosure of which is totally incorporated herein by reference, coated carrier components for electrostatographic developer mixtures comprised of finely divided toner particles clinging to the surface of the carrier particles. Specifically, there is disclosed in this patent coated carrier particles obtained by mixing carrier core particles of an average diameter of from between about 30 microns to about 1,000 microns with from about 0.05 percent to about 3.0 percent by weight, based on the weight of the coated carrier particles, of thermoplastic resin particles. The resulting mixture is then dry blended until the thermoplastic resin particles adhere to the carrier core by mechanical impaction, and/or electrostatic attraction. Thereafter, the mixture is heated to a temperature of from about 320° F. to about 650° F. for a period of 20 minutes to about 120 minutes, enabling the thermoplastic resin particles to melt and fuse on the carrier core. While the developer and carrier particles prepared in accordance with the process of this patent are suitable for their intended purposes, the conductivity values of the resulting particles are not believed to be constant in all instances, for example, when a change in carrier coating weight is accomplished to achieve a modification of the triboelectric charging characteristics; and further with regard to the '387 patent, in many situations carrier and developer mixtures with only specific triboelectric charging values can be generated when certain conductivity values or characteristics are contemplated. With the disclosure of the present application, in embodiments thereof the conductivity of the resulting carrier particles are in embodiments substantially constant, and moreover, the triboelectric values can be selected to vary significantly, for example from less than about 15 microcoulombs per gram to greater than about 35 microcoulombs per gram, depending on the polymer mixture selected for affecting the coating processes.

Carriers obtained by applying insulating resinous coatings to porous metallic carrier cores using solution coating techniques are undesirable from many viewpoints. For example, insufficient coating material may be present, and therefore, is not as readily available for triboelectric charging when the coated carrier particles are mixed with finely divided toner particles. Further, when resin coated carrier particles are prepared by the powder coating process, the majority of the coating materials are fused to the carrier surface thereby reducing the number of toner impaction sites on the carrier material.

Powder coating processes typically select polymers in the form of fine powders which can be mixed to coat the carrier core. The triboelectric charging value of the aforementioned carriers can be controlled by the polymer or mixture of polymers selected for the coating. The disadvantage of this approach is that only a limited number of polymers are available in the form of fine powders, especially for the preparation of conductive carriers. Two approaches are known for fabricating conductive carriers. First, conductive polymers which are in the form of fine powder can be utilized, for example a conductive carbon black loaded polymer, reference U.S. Pat. No. 5,236,629, the disclosure of which is totally incorporated herein by reference. A second approach is to partially coat the carrier core with polymer. However, coatings prepared by this method have the tendency to chip or flake off, and fail upon impact, or abrasive contact with machine parts and other carrier particles. These flakes or chips, which cannot readily be reclaimed from the developer mixture, have an adverse effect on the triboelectric charging characteristics of the carrier particles, thereby providing images with lower resolution in comparison to those compositions wherein the carrier coatings are retained on the surface of the core substrate. Furthermore, partially coated carriers have a short life, for example from about 1 to about 30 days, and poor stability.

Other patents of interest include U.S. Pat. No. 3,939,086, which illustrates steel carrier beads with polyethylene coatings, see column 6; U.S. Pat. No. 4,264,697, which discloses dry coating and fusing processes; U.S. Pat. Nos. 3,533,835; 3,658,500; 3,798,167; 3,918,968; 3,922,382; 4,238,558; 4,310,611; 4,397,935; 5,015,550; 5,002,846; 4,937,166, and 4,434,220.

Certain ferrite carriers are illustrated in U.S. Pat. Nos. 4,546,060; 4,764,445; 4,855,205, and 4,855,206. In the 4,855,205 patent there is disclosed a two phase ferrite composite with a spinel or S phase of the formula $MFe_2O_4$ and a magnetoplumbite or M phase, and which composite and magnetized. It is indicated in column 3 of this patent that the composites can be prepared by conventional procedures and that the composite can be coated with a polymer well known in the art. Examples of polymers include those as illustrated in U.S. Pat. No. 4,546,060, such as fluorocarbon polymers like polytetrafluoroethylene, polyvinylidenefluoride, and the like, see column 8.

Also of interest is U.S. Pat. No. 6,605,404, the disclosure of which is totally incorporated herein by reference, which discloses a process which comprises mixing a carrier core with a polymer core and polymer shell and wherein the polymer shell is present as a coating on said core and said polymer core, wherein said polymer core is generated by emulsification of and heating of monomer forming a seed latex; adding a portion of said seed latex to said emulsification mixture, followed by heating and adding another second portion of said seed latex; and wherein said shell is generated by emulsion polymerization of a monomer, followed by heating; and U.S. Pat. No. 6,391,509, the disclosure of which is totally incorporated herein by reference, which discloses a carrier containing a core, a polymer coating or mixtures of polymers thereover, and wherein the coating polymer or mixtures contains a conductive polymer.

The disclosures of each of the above patents are totally incorporated herein by reference. The appropriate carrier cores and polymer coatings, conductive components, such as the carbon blacks, of these patents may be selected for the present disclosure in embodiments thereof.

SUMMARY

It is a feature of the present disclosure to provide toner and developer compositions with many of the advantages illustrated herein, and which carriers may contain a polymer, or polymer mixture coating and a conductive component together with a alkali metal sulfate, such as sodium, lauryl sulfate.

In yet another feature of the disclosure there are provided carrier particles with substantially preselected constant conductivity parameters, and a wide range of preselected triboelectric charging values.

In yet a further feature of the present disclosure there are provided conductive carrier particles comprised of a coating generated from a mixture of monomers that, for example, are not in close proximity in the triboelectric series, that is for example, a mixture of monomers from different positions in the triboelectric series, and wherein the resulting coating has incorporated therein, or present therein or thereon a conductive component and an alkali lauryl sulfate (SLS).

In still a further feature of the present disclosure there are provided carrier particles with conductive components, with improved mechanical characteristics, carriers wherein the conductivity thereof is tunable by, for example, adjusting the concentration or amount of conductive polymer selected, and carriers wherein the coating adheres to the core and wherein there is minimal or no separation of the polymer coating from the core.

In yet another feature of the present disclosure there are provided conductive carrier particles comprised of a metallic or metal oxide core, and which carrier may contain a complete coating thereover generated from a mixture of a conductive carbon black and SLS.

Further, in an additional feature of the present disclosure there are provided carrier particles with a coating thereover generated from a mixture of polymers, and wherein the carrier triboelectric charging values are from about 15 to about 40 microcoulombs per gram at the same coating weight as determined by the known Faraday Cage technique.

Also, in another feature of the present disclosure there are provided positively charged toner compositions, or negatively charged toner compositions having incorporated therein metal or metal oxide carrier particles with a coating thereover of a polymer, a mixture of polymer coatings thereover, and preferably a mixture of two polymers, and which polymers contain a conductive carbon black and SLS.

Aspects of the present disclosure relate to carrier comprised of a core, a polymer coating, and wherein the coating contains a conductive component and an alkali metal lauryl sulfate like sodium lauryl sulfate (SLS); a carrier wherein the polymer coating is comprised of a mixture of polymers; a carrier wherein the mixture is comprised of 2 polymers; a carrier wherein the mixture is comprised of 2 polymers not in close proximity in the triboelectric series; a carrier wherein the mixture is comprised of from about 2 polymers to about 7 polymers; a carrier wherein the conductive component is carbon black; a carrier wherein the conductive component is a polymer of a polyaniline; a carrier wherein the polyaniline possesses a weight average molecular weight $M_w$ of from about 10,000 to about 400,000, or the polyaniline possesses a weight average molecular weight of from about 20,000 to about 100,000; a carrier wherein the polyaniline possesses an $M_w$ of from about 22,000 to about 75,000, and an $M_w/M_n$ ratio of from about 1.4 to about 2; a carrier wherein the conductive polymer is an organic polymer of a polyacetylene, a polypyrrole, a polythiophene, or a poly(p-phenylene sulfide); a carrier wherein the conductive polymer is polyacetylene; a carrier wherein the conductive polymer is present in an amount of from about 5 percent by weight to about 70 percent by weight based on the weight percent of the total of the polymer coating and the conductive polymer; a carrier wherein the conductive polymer is present in an amount of from about 5 percent by weight to about 25 percent by weight, or from about 10 percent by weight to about 20 percent by weight; a carrier wherein the carrier core diameter is from about 30 to about 100 microns; a carrier wherein the core is iron, steel or a ferrite; a carrier wherein the coating polymer is a styrene polymer; a carrier wherein the polymer coating is polyvinylidenefluoride, polyethylene, polymethyl methacrylate, polytrifluoroethylmethacrylate, copolyethylene vinylacetate, copolyvinylidenefluoride, tetrafluoroethylene, polystyrene, tetrafluoro ethylene, polyvinyl chloride, polyvinyl acetate, or mixtures thereof; a carrier wherein the polymer coating is polymethyl methacrylate, polystyrene, polytrifluoroethyl methacrylate, or mixtures thereof; a carrier wherein the polymer coating is comprised of a mixture of polymethyl methacrylate and polytrifluoroethyl methacrylate; a carrier wherein the polymer coating is present in a total amount of from about 0.5 to about 10 percent by weight of the carrier, or from about 1 to about 5 percent by weight of the carrier; a carrier with a conductivity of from about $10^{-15}$ to about $10^{-4}$ $(\text{ohm-cm})^{-1}$; a carrier with a triboelectric charge value of from about 15 to about 25 microcoulombs/gram and a conductivity of from about $10^{-15}$ to about $10^{-4}$ $(\text{ohm-cm})^{-1}$; a process for the preparation of carrier comprised of mixing carrier core with a mixture of polymer, conductive component and SLS, or monomer and initiator, optional chain transfer agent and optional crosslinking agent; polymerizing the monomer by heating resulting in a polymer contained on the carrier core and conductive component, and SLS present in the carrier polymer coating; a process wherein the mixture is heated at a temperature of from about 50° C. to about 95° C., or from about 60° C. to about 85° C., optionally for a period of from about 30 minutes to about 5 hours, or from about 30 minutes to about 3 hours; a process wherein the monomer is selected from the group consisting of acrylic acid, methyl acrylate, ethyl acrylate, n-butyl acrylate, isobutyl acrylate, dodecyl acrylate, n-octyl acrylate, 2-chloroethyl acrylate, phenyl acrylate, methylalphachloracrylate, methacrylic acids, methyl methacrylate, ethyl methacrylate, butyl methacrylate, octyl methacrylate, acrylonitrile, methacrylonitrile and acrylamide; maleic acid, monobutyl maleate, dibutyl maleate; vinyl chloride, vinyl bromide, vinyl fluoride, vinyl acetate and vinyl benzoate; vinylidene chloride; pentafluoro styrene, allyl pentafluorobenzene, N-vinyl pyrrole, and trifluoroethyl methacrylate; and mixtures thereof, and wherein the monomer is present in an amount of from about 1 to about 5 percent by weight of the carrier core, or wherein the monomer is methyl methacrylate, styrene, trifluoroethyl methacrylate, or mixtures thereof, and wherein the monomer is present in an amount of from about 0.5 to about 10 percent by weight, or from about 1 to about 5 percent by weight of the carrier core, and where the amount of the conductive additive present is from about 10 to about 70 percent by weight, or from about 20 to about 50 percent by weight of the monomer mixture; a developer comprised of the carrier of the present disclosure and toner; a carrier wherein the polymer coating is an organosiloxane or an organosilane; a developer wherein the toner is comprised of a thermoplastic resin, colorant and optionally toner additives, and wherein the additives are charge additives, wax, surface additives and mixtures thereof; a conductive coated carrier wherein the core diameter is about 30 to about 100 microns as measured by a Malvern laser diffractometer; a conductive coated carrier wherein the core is iron, steel or a ferrite, such as an iron ferrite, strontium ferrite, and the like; a conductive carrier containing a second polymer coating of, for example, a vinyl polymer or a condensation polymer; a conductive carrier wherein the second polymer coating is a polystyrene, polyvinylidenefluoride, polyethylene, polymethyl methacrylate, polytrifluoroethylmethacrylate, copolyethylene vinylacetate, copolyvinylidenefluoride, tetrafluoroethylene, polystyrene, tetrafluoroethylene, polyvinyl chloride, polyvinyl acetate, or mixtures thereof, for example from about 1 to about 99 parts of a first coating and from about 99 to about 1 of a second coating, and wherein the total thereof is about 100 percent, or mixtures thereof, and wherein the polymer coating is present in a amount of from about 0.05 to about 2 percent by weight of the carrier; wherein the conductive component is present in an amount of from about 0.05 to about 20 percent by weight of the polymer coating or polymer coatings; a carrier with a triboelectric charge value of from about 15 to about 25 microcoulombs/gram; carrier with a conductivity of from about $10^{-15}$ to about $10^{-4}$ mho/cm; a carrier with a triboelectric charge value of from about 15 to about 25 microcoulombs/gram and a conductivity of from about $10^{-15}$ to about $10^{-4}$ mho/cm; a process for the preparation of carrier comprised of mixing carrier core with a mixture of monomers and initiator, optional chain transfer agent, and optional crosslinking agent; polymerizing the monomer by heating thereby resulting in a polymer contained on the carrier surface, and thereafter adding a conductive component mixture of carbon black and SLS, and optionally drying; a process wherein the monomer mixture further contains a conductive monomeric additive; a process wherein the monomer mixture is heated at a temperature of from about 50° C. to about 95° C., or from about 60° C. to about 85° C.; a process wherein the monomer mixture is heated for a period of from about 30 minutes to about 5 hours, or from about 30 minutes to about 3 hours; a process wherein the monomer is selected from the group consisting of styrene, α-methyl styrene, p-chlorostyrene, monocarboxylic acids and the derivatives thereof; dicarboxylic acids with a double bond and derivatives thereof; vinyl ketones; vinyl naphthalene; unsaturated mono-olefins; vinylidene halides; N-vinyl compounds; fluorinated vinyl compounds; and mixtures thereof; a process wherein the monomer is selected from the group consisting of acrylic acid, methyl acrylate, ethyl acrylate, n-butyl acrylate, isobutyl acrylate, dodecyl acrylate, n-octyl acrylate, 2-chloroethyl acrylate, phenyl acrylate, methylalphachloracrylate, methacrylic acids, methyl methacrylate, ethyl methacrylate, butyl methacrylate, octyl methacrylate, acrylonitrile, methacrylonitrile and acrylamide; maleic acid, monobutyl maleate, dibutyl maleate; vinyl chloride, vinyl bromide, vinyl fluoride, vinyl acetate and vinyl benzoate; vinylidene chloride; pentafluoro styrene, allyl pentafluorobenzene, N-vinyl pyrrole, and trifluoroethyl methacrylate; and mixtures thereof; a process wherein the monomer is methyl methacrylate, styrene, trifluoroethyl methacrylate, or mixtures thereof, and where the amount of the conductive additive present is from about 0 to about 20 percent by weight, or from about 1 to about 10 percent by weight; a process wherein the initiator is selected from the group consisting of azo compounds, peroxides, and mixtures thereof, and where the amount of the initiator is from about 0.1 to about 20 percent by weight, or from about 0.5 to about 10 percent by weight of the monomer mixture; a process wherein the initiator is selected from the group consisting of 2,2'-azodimethylvaleronitrile, 2,2'-azoisobutyronitrile, azobiscyclohexanenitrile, 2-methylbutyronitrile, benzoyl peroxides, lauryl peroxide, 1-1-(t-butylperoxy)-3,3,5-trimethylcyclohexane, n-butyl-4,4-di-(t-butylperoxy)valerate, dicumyl peroxide, and mixtures thereof; a process wherein the crosslinking agent is selected from the group consisting of compounds having two or more polymerizable double bonds, and where the amount of the crosslinking agent is from about 0.1 to about 5 percent by weight, or from about 0.5 to about 3 percent by weight of the monomer mixture; a process wherein the crosslinking agent is selected from the group consisting of divinylbenzene, divinylnaphthalene, ethylene glycol diacrylate, ethylene glycol dimethylacrylate, divinyl ether, divinyl sulfite, divinyl sulfone, and mixtures thereof; a process wherein the chain transfer agent is selected from the group consisting of mercaptans and halogenated hydrocarbons, and wherein the chain transfer agent is selected in an amount of from about 0.01 to about 1 percent by weight, or from about 0.05 to about 0.5 percent by weight of the monomer mixture; a process wherein the chain transfer agent is selected from the group consisting of laurylmercaptan, butylmercaptan carbon tetrachloride, carbon tetrabromide and mixtures thereof; and a developer comprised of conductive carrier particles and toner.

With further reference to the monomer mixture utilized to achieve the polymer or copolymer coating, close proximity refers to the choice of the polymers selected as dictated by their position in the triboelectric series, therefore for example, one may select a first polymer with a significantly lower triboelectric charging value than the second polymer. For example, the triboelectric charge of a steel carrier core with a polyvinylidenefluoride coating is about −75 microcoulombs per gram. However, the same carrier, with the exception that there is selected a coating of polymethylmethacrylate, has a triboelectric charging value of about 40 microcoulombs per gram. More specifically, not in close proximity refers to first and second polymers that are at different electronic work function values, that is the polymers are not at the same electronic work function value; and further, the first and second polymers are comprised of different components. Additionally, the difference in electronic work functions in embodiment between the first and second polymer is, for example, at least 0.2 electron volt, and preferably is about 2 electron volts; and moreover, it is known that the triboelectric series corresponds to the known electronic work function series for polymers, reference "Electrical Properties of Polymers", Seanor, D. A., Chapter 17, *Polymer Science*, A. D. Jenkins, Editor, North Holland Publishing (1972), the disclosures of which are totally incorporated herein by reference.

The percentage of each polymer present in the carrier coating mixture can vary depending on the specific components selected, the coating weight and the properties desired. Generally, the coated polymer mixtures contain from about 10 to about 90 percent of a first polymer, and from about 90 to about 10 percent by weight of a second polymer. Preferably, there are selected mixtures of polymers with from about 40 to about 60 percent by weight of a first polymer, and from about 60 to about 40 percent by weight of a second polymer.

There results, in accordance with aspects of the present disclosure, carrier particles of relatively constant conductivities of from about $10^{-15}$ (ohm-cm)$^{-1}$ to about $10^{-4}$ (ohm-cm)$^{-1}$, and more specifically, from about $10^{-8}$ (ohm-cm)$^{-1}$ to about $10^{-6}$ (ohm-cm)$^{-1}$ at, for example, a 10 volt potential across a 0.1 inch gap containing carrier beads held in place by a magnet; and wherein the carrier particles are of a triboelectric charging value of from about 15 to about 65 microcoulombs per gram, and preferably from about 15 to about 25 microcoulombs per gram as determined by a Faraday Cage, these parameters being dependent on the carrier coatings selected, and the percentage of each of the polymers used, and the conductive polymer.

Various suitable solid core carrier materials can be selected, inclusive of known porous cores. Characteristic core properties of importance include those that will enable the toner particles to acquire a positive or a negative charge, and carrier cores that will permit desirable flow properties in the developer reservoir present in the xerographic imaging apparatus. Also of value with regard to the carrier core properties are, for example, suitable soft magnetic characteristics that permit magnetic brush formation in magnetic brush development processes, and wherein the carrier cores possess desirable aging characteristics. By soft magnetic is meant, for example, a developer that develops an induced magnetic field only when exposed to an external magnetic field, and which field is immediately diminished when the external field is removed. Examples of carrier cores that can be selected include iron, iron alloys, steel, ferrites, magnetites, nickel, other known carrier cores, and mixtures thereof. Alloys of iron include iron-silicon, iron-aluminum-silicon, iron-nickel, iron-cobalt, and mixtures thereof. Ferrites include a class of magnetic oxides that contain iron as the major metallic component, and optionally a second metallic component including magnesium, manganese, cobalt, nickel, zinc, copper, and mixtures thereof. Preferred carrier cores include ferrites containing iron, nickel, zinc, copper, manganese, and mixtures thereof, and sponge iron, with a volume average diameter of from about 30 to about 100 microns, and preferably from about 30 to about 50 microns as measured by a Malvern laser diffractometer. Examples of monomers or comonomers which can be polymerized to form a polymer coating on the carrier surface in an amount of, for example, from about 0.5 to about 10 percent, and preferably from about 1 to about 5 percent by weight of carrier core include vinyl monomers such as styrene, p-chlorostyrene, vinyl naphthalene and the like; monocarboxylic acids and their derivatives such as acrylic acid, methyl acrylate, ethyl acrylate, n-butyl acrylate, isobutyl acrylate, dodecyl acrylate, n-octyl acrylate, 2-chloroethyl acrylate, phenyl acrylate, methylalphachloracrylate, methacrylic acids, methyl methacrylate, ethyl methacrylate, butyl methacrylate, octyl methacrylate, acrylonitrile, methacrylonitrile, acrylamide and trifluoroethyl methacrylate, dicarboxylic acids having a double bond and their derivatives such as maleic acid, monobutyl maleate, dibutyl maleate, unsaturated monoolefins such as ethylene, propylene, butylene and isobutylene; vinyl halides such as vinyl chloride, vinyl bromide, vinyl fluoride; vinyl esters such as vinyl acetate, vinyl propionate, vinyl benzoate and vinyl butyrate; vinyl ethers, inclusive of vinyl methyl ether, vinyl isobutyl ether and vinyl ethyl ether; vinyl ketones inclusive of vinyl methyl ketone, vinyl hexyl ketone and methyl isopropenyl ketone; vinylidene halides such as vinylidene chloride and vinylidene chlorofluoride; N-vinyl compounds such as N-vinyl indole and N-vinyl pyrrolidene; fluorinated monomers such as pentafluoro styrene, allyl pentafluorobenzene and the like, other suitable known monomers, and mixtures thereof.

Toners can be admixed with the carrier to generate developers. As one toner resin there can be selected the esterification products of a dicarboxylic acid and a diol comprising a diphenol, reference U.S. Pat. No. 3,590,000, the disclosure of which is totally incorporated herein by reference, reactive extruded crosslinked polyesters, such as those illustrated in U.S. Pat. No. 5,227,460, the disclosure of which is totally incorporated herein by reference, and the like. Preferred toner resins include styrene/methacrylate copolymers; styrene/butadiene copolymers; polyester resins obtained from the reaction of bisphenol A and propylene oxide; and branched polyester resins resulting from the reaction of dimethylterephthalate, 1,3-butanediol, 1,2-propanediol and pentaerythritol. Other toner resins are illustrated in a number of U.S. patents including some of the patents recited hereinbefore.

Generally, from about 1 part to about 5 parts by weight of toner are mixed with from about 10 to about 300 parts by weight of the carrier particles.

Numerous well known suitable colorants, such as pigments or dyes, can be selected as the colorant for the toner including, for example, cyan, magenta, yellow, red, blue, carbon black, nigrosine dye, lamp black, iron oxides, magnetites, and mixtures thereof. The colorant, which is preferably carbon black, should be present in a sufficient amount to render the toner composition highly colored. Thus, the colorant particles can be present in amounts of from about 3 percent by weight to about 20, and preferably from about 3 to about 12 weight percent or percent by weight, based on the total weight of the toner composition, however, lesser or greater amounts of colorant particles can be selected. Colorant includes pigment, dye, mixtures thereof, mixtures of pigments, mixtures of dyes, and the like.

When the colorant particles are comprised of magnetites, which are a mixture of iron oxides ($FeO.Fe_2O_3$) including those commercially available as Mapico Black, they are usually present in the toner composition in an amount of from about 10 percent by weight to about 70 percent by weight, and preferably in an amount of from about 20 percent by weight to about 50 percent by weight.

The resin particles are present in a sufficient, but effective amount, thus when 10 percent by weight of pigment, or colorant, such as carbon black, is contained therein, about 90 percent by weight of resin is selected. Generally, the toner composition is comprised of from about 85 percent to about 97 percent by weight of toner resin particles, and from about 3 percent by weight to about 15 percent by weight of colorant particles.

The developer compositions can be comprised of thermoplastic resin particles, carrier particles and as colorants, magenta, cyan and/or yellow particles, and mixtures thereof. More specifically, illustrative examples of magentas include 1,9-dimethyl-substituted quinacridone and anthraquinone dye identified in the color index as CI 60720, CI Dispersed Red 15, a diazo dye identified in the color index as CI 26050, CI Solvent Red 19, and the like. Examples of cyans include copper tetra-4(octaecyl sulfonamido) phthalocyanine, X-copper phthalocyanine pigment listed in the color index as CI 74160, CI Pigment Blue, and Anthrathrene Blue, identified in the color index as CI 69810, Special Blue X-2137, and the like; while illustrative examples of yellows are diarylide yellow 3,3-dichlorobenzidene acetoacetanilides, a monoazo pigment identified in the color index as CI 12700, CI Solvent Yellow 16, a nitrophenyl amine sulfonamide identified in the color index as Foron Yellow SE/GLN, CI Dispersed Yellow 33, 2,5-dimethoxy-4-sulfonanilide phenylazo-4'-chloro-2,5-dimethoxy aceto-acetanilide, permanent Yellow FGL, and the like. The colorants, which include pigments, mixtures of pigments, dyes, mixtures of dyes, mixtures of dyes and pigments, and the like, are generally present in the toner composition in an amount of from about 1 weight percent to about 15 weight percent based on the weight of the toner resin particles.

For further enhancing the positive charging characteristics of the developer compositions illustrated herein, and as optional components there can be incorporated therein known charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; metal complexes, E-88™, naphthalene sulfonates, quaternary ammonium compounds; and other similar known charge enhancing additives. These additives are usually incorporated into the toner or carrier coating in an amount of from about 0.1 to about 20 percent by weight, and preferably from about 1 to about 7 weight percent by weight.

The toner composition can be prepared by a number of known methods including melt blending the toner resin particles, and pigment particles or colorants of the present disclosure followed by mechanical attrition. Other methods include emulsion aggregates spray drying, melt dispersion, dispersion polymerization and suspension polymerization. In one dispersion polymerization method, a solvent dispersion of the resin particles and the colorant particles are spray dried under controlled conditions to result in the desired product.

Examples of imaging members selected for the imaging processes illustrated herein are selenium, selenium alloys, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. Nos. 4,265,990; 4,585,884; 4,584,253, and 4,563,406, the disclosures of which are totally incorporated herein by reference, and other similar layered photoresponsive devices. Examples of generating layers are trigonal selenium, metal phthalocyanines, perylenes, titanyl phthalocyanines, metal free phthalocyanines, hydroxy gallium phthalocyanines, such as Type V hydroxy gallium phthalocyanine, and vanadyl phthalocyanines. As charge transport molecules there can be selected, for example, the aryl diamines disclosed in the '990 patent. Also, there can be selected as photogenerating pigments, squaraine compounds, thiapyrillium materials, and the like. These layered members are conventionally charged negatively thus usually requiring a positively charged toner.

Moreover, the developer compositions of the present disclosure are particularly useful in electrostatographic imaging processes and apparatuses wherein there is selected a moving transporting means and a moving charging means; and wherein there is selected a deflected flexible layered imaging member, reference U.S. Pat. Nos. 4,394,429 and 4,368,970, the disclosures of which are totally incorporated herein by reference. Images obtained with the developer composition of the present disclosure in embodiments possessed acceptable solids, excellent halftones and desirable line resolution with acceptable or substantially no background deposits.

The present disclosure enables in embodiments carriers with a wide range of triboelectric charging values, selected carrier conductivity, and small carrier size, for example from about 30 to about 100 microns, and preferably from about 30 to about 50 microns in volume average diameter as determined by a Malvern laser diffractometer. Further, when resin coated carrier particles are prepared by the polymerization process of the present disclosure, the majority, that is over about 90 percent of the coating materials, such as polymer or polymers, are fused to the carrier surface thereby reducing the number of toner impaction sites on the carrier material. Additionally, there can be achieved with the process of the present disclosure, independent of one another, desirable triboelectric charging characteristics and conductivity values; that is, for example the triboelectric charging parameter is not primarily dependent on the carrier coating weight as is believed to be the situation with the process of U.S. Pat. No. 4,233,387, wherein an increase in coating weight on the carrier particles may function to also permit an increase in the triboelectric charging characteristics. Specifically, therefore, with the carrier compositions and process of the present disclosure there can be formulated developers with selected triboelectric charging characteristics and/or conductivity values in a number of different combinations.

Accordingly, for example, there can be formulated in accordance with the disclosure of the present application carriers with conductivities, carrier particles of from about $10^{-15}$ (ohm-cm)$^{-1}$ to about $10^{-4}$ (ohm-cm)$^{-1}$, and preferably from about $10^{-12}$ (ohm-cm)$^{-1}$ to about $10^{-6}$ (ohm-cm)$^{-1}$, as determined in a magnetic brush conducting cell; and triboelectric charging values of from about 20 to about 65 microcoulombs per gram, and preferably from about 25 to about 35 microcoulombs per gram, on the carrier particles as determined by the known Faraday Cage technique. The developers of the present disclosure can be formulated with constant conductivity values with different triboelectric charging characteristics by, for example, maintaining the same coating weight on the carrier particles and changing the polymer coating ratios. Similarly, there can be formulated developer compositions wherein constant triboelectric charging values are achieved, and the conductivities are altered by retaining the polymer ratio coating constant and modifying the coating weight for the carrier particles.

The following Examples are being provided to further illustrate the present disclosure, it being noted that these Examples are intended to illustrate and not limit the scope of the present disclosure. Parts and percentages are by weight unless otherwise indicated.

CARRIER EXAMPLE I 22.7 Grams of VULCAN 72® carbon black and 431.3 grams of SLS (sodium lauryl sulfate) PMMA (polymethyl methacrylate) were mixed in a 5 liter Littleford M5R blender for 4 minutes at 415 RPM. 27.24 Grams of the resultant SLS PMMA/carbon black mixture were then added to 4,540 grams of Hoeganaes 90 μm steel core in a 5 liter Littleford M5R blender and mixed for 45 minutes at 415 RPM. The resultant mixture of core and coating materials was then processed through a 3 inch diameter rotary furnace under conditions of a 0.4 degree angle and 6 RPM and a feed rate of 43 grams per minute. Under these conditions, the mixture had a 30 minute residence time in the furnace, which mixture was then heated to 385° F., thereby causing the polymer to melt and fuse to the core. This resulted in a polymer coating on the core surface. The final product was comprised of a carrier core with a total of 0.6 percent polymer by weight on the surface with the sodium lauryl sulfate poly(methyl methacrylate) comprising 95 percent of the coating and carbon black comprising the other 5 percent.

A developer composition was then prepared by mixing 150 grams of the above prepared carrier with 4.5 grams of a 9 micron volume median diameter (volume average diameter) toner composition comprised of a partially crosslinked polyester resin with 37 percent (by weight) gel content, obtained by the reactive extrusion of a linear bisphenol A propylene oxide fumarate polymer and 5 weight percent of carbon black pigment, and incorporating 4 percent of a known wax, low molecular weight polypropylene, polyethylene or mixtures thereof, and 3 percent compatibalizer. The toner composition contained as external surface additives 2.8 percent by weight of 30 nanometer size hydrophobic silica; 2.1 percent by weight of a 40 nanometer size hydrophobic titania, and 0.24 weight percent of zinc stearate. This developer was conditioned overnight, about 12 hours, at 70° F. and 50 percent RH. The resulting developer was shaken on a paint shaker, and a 0.5 gram sample was removed after 5 minutes. Thereafter, the triboelectric charge on the carrier particles was determined by the known Faraday Cage process, and there was measured on the carrier a charge of 31.5 microcoulombs per gram. Further, the conductivity of the carrier as determined by forming a 0.1 inch ion magnetic brush of the carrier particles, and measuring the conductivity by imposing a 10 volt potential across the brush was $7.6\times10^{-11}$ (ohm-cm)$^{-1}$.

CARRIER EXAMPLE II 22.7 Grams of VULCAN 72® carbon black and 431.3 grams of SLS PMMA were mixed in a 5 liter Littleford M5R blender for 4 minutes at 415 RPM. 45.4 Grams of the resultant SLS PMMA/carbon black mixture were then added to 4,540 grams of Hoeganaes 90 μm steel core in a 5 liter Littleford M5R blender and mixed for 45 minutes at 415 RPM. The resultant mixture of core and coating materials was then processed through a 3 inch diameter rotary furnace under the conditions described in Carrier Example I. The final product was comprised of a carrier core with a total of 1 percent polymer by weight on the surface with the sodium lauryl sulfate poly(methyl methacrylate) comprising 95 percent of the coating and carbon black comprising the other 5 percent.

A developer composition was then prepared by repeating the process of Carrier Example I. The developer was conditioned as described in Carrier Example I. The triboelectric charge on the carrier was a measured 33.3 microcoulombs per gram. Further, the conductivity was $7.5\times10^{-14}$ (ohm-cm)$^{-1}$ as determined by the process of Carrier Example I.

CARRIER EXAMPLE III 22.7 Grams of VULCAN 72® carbon black and 431.3 grams of SLS PMMA were mixed in a 5 liter Littleford M5R blender for 4 minutes at 415 RPM. 27.24 Grams of the resultant SLS PMMA/carbon black mixture were then added to 4,540 grams of Hoeganaes 90 μm steel core in a 5 liter Littleford M5R blender and mixed for 45 minutes at 415 RPM. The resultant mixture of core and coating materials was then processed through a 3 inch diameter rotary furnace under conditions of a 0.4 degree angle and 6 RPM, and a feed rate of 43 grams per minute. Under these conditions, the mixture had a 30 minute residence time in the furnace, which was heated to 450° F., thereby causing the polymer to melt and fuse to the core. The final product was comprised of a carrier core with a total of 0.6 percent polymer by weight on the surface with the sodium lauryl sulfate poly (methyl methacrylate) comprising 95 percent of the coating and carbon black comprising the other 5 percent.

A developer composition was then prepared following the same procedure as Carrier Example I and the developer was conditioned the same as described in Carrier Example I. The triboelectric charge on the carrier was 29.6 microcoulombs per gram. The conductivity was $5.2\times10^{-10}$ (ohm-cm)$^{-1}$ as determined by the process of Carrier Example I.

CARRIER EXAMPLE IV 22.7 Grams of VULCAN 72® carbon black and 431.3 grams of SLS PMMA were mixed in a 5 liter Littleford M5R blender for 4 minutes at 415 RPM. 45.4 Grams of the resultant SLS PMMA/carbon black mixture were then added to 4,540 grams of Hoeganaes 90 μm steel core in a 5-liter Littleford M5R blender and mixed for 45 minutes at 415 RPM. The resultant mixture of core and coating materials was then processed through a 3 inch diameter rotary furnace under the conditions described in Carrier Example III. The final product was comprised of a carrier core with a total of 1 percent polymer by weight on the surface with the sodium lauryl sulfate poly(methyl methacrylate) comprising 95 percent of the coating and carbon black comprising the other 5 percent.

A developer composition was then prepared by the procedure described in Carrier Example I. The developer was conditioned the same as described in Carrier Example I with the triboelectric charge on the carrier being 29.6 microcoulombs per gram. Further, the conductivity was $5.2\times10^{-10}$ (ohm-cm)$^{-1}$ as determined by the process of Carrier Example I.

CARRIER EXAMPLE V 22.7 Grams of VULCAN 72® carbon black and 431.3 grams of SLS PMMA were mixed in a 5 liter Littleford M5R blender for 4 minutes at 415 RPM. 9.08 Grams of the resultant SLS PMMA/carbon black mixture were then added to 4,540 grams of Hoeganaes 90 μm steel core in a 5 liter Littleford M5R blender and mixed for 10 minutes at 220 RPM. The resultant mixture of core and coating materials was then processed through a 3 inch diameter rotary furnace under conditions of 0.4 degree angle and 6 RPM, and a feed rate of 43 grams per minute. Under these conditions, the mixture had a 30 minute residence time in the furnace, which was heated to 390° F., thereby causing the polymer to melt and fuse to the core. The final product was comprised of a carrier core with a total of 0.2 percent polymer by weight on the surface with the sodium lauryl sulfate poly (methyl methacrylate) comprising 95 percent of the coating and carbon black comprising the other 5 percent.

A developer composition was then prepared by the procedure of Carrier Example I. The developer was conditioned as described in Carrier Example I and the triboelectric charge on the carrier of 23.8 microcoulombs per gram. Further, the conductivity was $1\times10^{-8}$ (ohm-cm)$^{-1}$ as determined by the process of Carrier Example I.

CARRIER EXAMPLE VI 22.7 Grams of VULCAN 72® carbon black and 431.3 grams of SLS PMMA were mixed in a 5 liter Littleford M5R blender for 4 minutes at 415 RPM. 13.62 Grams of the resultant SLS PMMA/carbon black mixture were then added to 4,540 grams of Hoeganaes 90 μm steel core in a 5 liter Liftleford M5R blender and mixed for 10 minutes at 220 RPM. The resultant mixture of core and coating materials was then processed through a 3 inch diameter rotary furnace under the conditions described in Carrier Example III. The final product was comprised of a carrier core with a total of, 0.3 percent polymer by weight on the surface with the sodium lauryl sulfate poly(methyl methacrylate) comprising 95 percent of the coating and carbon black comprising the other 5 percent.

A developer composition was then prepared following the procedure described in Carrier Example I. The developer was then conditioned the same as described in Carrier Example I and the triboelectric charge on the carrier was 21.2 microcoulombs per gram. Further, the conductivity was $2.2\times10^{-8}$ (ohm-cm)$^{-1}$ as determined by the process of Carrier Example I.

CARRIER EXAMPLE VII 13.62 Grams of SLS PMMA were added to 4,540 grams of Hoeganaes 90 μm steel core in a 5 liter Littleford M5R blender and mixed for 10 minutes at 220 RPM. The resultant mixture of core and coating material was then processed through a 3 inch diameter rotary furnace under the conditions of Carrier Example V. The final product was comprised of a carrier core with a total of 0.3 percent polymer by weight on the surface with the sodium lauryl sulfate poly (methyl methacrylate) comprising 100 percent of the coating.

A developer composition was then prepared with the same procedure described in Carrier Example I. The developer was conditioned as described in Carrier Example I with the triboelectric charge on the carrier being 28.9 microcoulombs per gram. Further, the conductivity was $1.0\times10^{-9}$ (ohm-cm)$^{-1}$ as determined by the process of Carrier Example I.

CARRIER EXAMPLE VIII 9.08 Grams of SLS PMMA were added to 4,540 grams of Hoeganaes 90 μm steel core in a 5 liter Littleford M5R blender and mixed for 10 minutes at 220 RPM. The resultant mixture of core and coating material was then processed through a 3 inch diameter rotary furnace under the conditions of Carrier Example III. The final product was comprised of a carrier core with a total of 0.2 percent polymer by weight on the surface with the sodium lauryl sulfate poly(methyl methacrylate) comprising 100 percent of the coating.

A developer composition was then prepared following the procedure of Carrier Example I. The developer was conditioned as described in Carrier Example I with the triboelectric charge on the carrier being 21.3 microcoulombs per gram. Further, the conductivity was $9.8\times10^{-9}$ (ohm-cm)$^{-1}$ as determined by the process of Carrier Example I.

CARRIER EXAMPLE IX 45.4 Grams of VULCAN 72® carbon black and 408.6 grams of SLS PMMA were mixed in a 5 liter Littleford M5R blender for 4 minutes at 415 RPM. 27.24 Grams of the resultant SLS PMMA/carbon black mixture were then added to 4,540 grams of Hoeganaes 90 μm steel core in a 5 liter Littleford M5R blender and mixed for 45 minutes at 415 RPM. The resultant mixture of core and coating materials was then processed through a 3 inch diameter rotary furnace under the conditions described in Carrier Example III. The final product was comprised of a carrier core with a total of 0.6 percent polymer (PMMA) by weight on the surface with the sodium lauryl sulfate poly(methyl methacrylate) comprising 90 percent of the coating and carbon black comprising the other 10 percent.

A developer composition was then prepared by the procedure described in Carrier Example I. The developer was conditioned the same as described in Carrier Example I with the triboelectric charge on the carrier being 24.9 microcoulombs per gram. Further, the conductivity was $3.3\times10^{-9}$ (ohm-cm)$^{-1}$ as determined by the process of Carrier Example I.

CARRIER EXAMPLE X 45.4 Grams of VULCAN 72® carbon black and 408.6 grams of SLS PMMA were mixed in a 5 liter Littleford M5R blender for 4 minutes at 415 RPM. 45.4 Grams of the resultant SLS PMMA/carbon black mixture were then added to 4,540 grams of Hoeganaes 90 μm steel core in a 5 liter Littleford M5R blender and mixed for 45 minutes at 415 RPM. The resultant mixture of core and coating materials was then processed through a 3 inch diameter rotary furnace under the conditions described in Carrier Example III. The final product was comprised of a carrier core with a total of 1 percent polymer (PMMA) by weight on the surface with the sodium lauryl sulfate poly(methyl methacrylate) comprising 90 percent of the coating and carbon black comprising the other 10 percent.

A developer composition was then prepared by the procedure described in Carrier Example I. The developer was conditioned as described in Carrier Example I with the triboelectric charge on the carrier being 30.5 microcoulombs per gram. Further, the conductivity was $6.8\times10^{-9}$ (ohm-cm)$^{-1}$ as determined by the process of Carrier Example I.

CARRIER EXAMPLE XI 90.8 Grams of VULCAN 72® carbon black and 363.2 grams of SLS PMMA were mixed in a 5 liter Littleford M5R blender for 4 minutes at 415 RPM. 45.4 Grams of the resultant SLS PMMA/carbon black mixture were then added to 4,540 grams of Hoeganaes 90 μm steel core in a 5 liter Littleford M5R blender, and mixed for 45 minutes at 415 RPM. The resultant mixture of core and coating materials was then processed through a 3 inch diameter rotary furnace under the conditions described in Carrier Example III. The final product was comprised of a carrier core with a total of 1 percent polymer by weight on the surface with the sodium lauryl sulfate poly(methyl methacrylate) comprising 80 percent of the coating and carbon black comprising the other 20 percent of the coating.

A developer composition was then prepared by the procedure described in Carrier Example I. The developer was conditioned as described in Carrier Example I and the triboelectric charge on the carrier of 22.9 microcoulombs per gram. Further, the conductivity was $1.5\times10^{-8}$ (ohm-cm)$^{-1}$ as determined by the process of Carrier Example I.

CARRIER EXAMPLE XII 68.1 Grams of VULCAN 72® carbon black and 385.9 grams of SLS PMMA were mixed in a 5 liter Littleford M5R blender for 4 minutes at 415 RPM. 45.4 Grams of the resultant SLS PMMA/carbon black mixture were then added to 4,540 grams of Hoeganaes 90 μm steel core in a 5 liter Littleford M5R blender and mixed for 45 minutes at 415 RPM. The resultant mixture of core and coating materials was then processed through a 3 inch diameter rotary furnace under the conditions described in Carrier Example III. The final product was comprised of a carrier core with a total of 1 percent polymer (PMMA) by weight on the surface sodium lauryl sulfate poly(methyl methacrylate) comprising 85 percent of the coating and carbon black comprising the other 15 percent of the coating.

A developer composition was then prepared with the same procedure described in Carrier Example I. The developer was conditioned the same as described in Carrier Example I with the triboelectric charge on the carrier of 27.4 microcoulombs per gram. Further, the conductivity was $5.4\times10^{-9}$ (ohm-cm)$^{-1}$ as determined by the process of Carrier Example I.

CARRIER EXAMPLE XIII 22.7 Grams of VULCAN 72® carbon black and 431.3 grams of SLS PMMA were mixed in a 5 liter Littleford M5R blender for 4 minutes at 415 RPM. 9.08 Grams of the resultant SLS PMMA/carbon black mixture were then added to 4,540 grams of Hoeganaes 90 μm steel core in a 5 liter Littleford M5R blender and mixed for 10 minutes at 220 RPM. The resultant mixture of core and coating materials was then processed through a 3 inch diameter rotary furnace under the conditions of Carrier Example V. The final product was comprised of a carrier core with a total of 0.2 percent on the surface sodium lauryl sulfate poly(methyl methacrylate) comprising 95 percent of the coating and carbon black comprising the other 5 percent (by weight) of the coating.

A developer composition was then prepared by the procedure of Carrier Example I. The developer was conditioned the same as described in Carrier Example I and the triboelectric charge on the carrier of 24.5 microcoulombs per gram. Further, the conductivity was $2.4\times10^{-8}$ (ohm-cm)$^{-1}$ as determined using the same process described in Carrier Example I.

CARRIER EXAMPLE XIV 9.08 Grams of SLS PMMA were added to 4,540 grams of Hoeganaes 90 μm steel core in a 5 liter Littleford M5R blender and mixed for 10 minutes at 220 RPM. The resultant mixture of core and coating material was then processed through a 3 inch diameter rotary furnace under the conditions of Carrier Example III. The final product was comprised of a carrier core with a total of 0.2 percent polymer by weight on the surface and sodium lauryl sulfate poly (methyl methacrylate) comprising 100 percent of the coating.

A developer composition was then prepared by the process of Carrier Example I. The developer was conditioned as indicated in Carrier Example I; the triboelectric charge on the carrier of 23.3 microcoulombs per gram. Further, the conductivity was $8.9\times10^{-9}$ (ohm-cm)$^{-1}$ as determined by the process of Carrier Example I.

CARRIER EXAMPLE XV 45.4 Grams of VULCAN 72® carbon black and 408.6 grams of SLS PMMA were mixed in a 5 liter Littleford M5R blender for 4 minutes at 415 RPM. 4.54 Grams of the resultant SLS PMMA/carbon black mixture were then added to 4,540 grams of Hoeganaes 90 μm steel core in a 5 liter Littleford M5R blender and mixed for 10 minutes at 220 RPM. The resultant mixture of core and coating materials was then processed through a 3 inch diameter rotary furnace under the conditions of Carrier Example III. The final product was comprised of a carrier core with a total of 0.1 percent polymer by weight on the surface with the sodium lauryl sulfate poly(methyl methacrylate) comprising 90 percent of the coating and carbon black comprising the other 10 percent by weight of the coating.

A developer composition was then prepared by the process of Carrier Example I. The developer was conditioned by the process of Carrier Example I; the triboelectric charge on the carrier was 18.5 microcoulombs per gram. Further, the conductivity was $1.2\times10^{-7}$ (ohm-cm)$^{-1}$ as determined by the process of Carrier Example I.

CARRIER EXAMPLE XVI 45.4 Grams of VULCAN 72® carbon black and 408.6 grams of SLS PMMA were mixed in a 5 liter Littleford M5R blender for 4 minutes at 415 RPM. 9.08 Grams of the resultant SLS PMMA/carbon black mixture were then added to 4,540 grams of Hoeganaes 90 μm steel core in a 5 liter Littleford M5R blender and mixed for 10 minutes at 220 RPM. The resultant mixture of core and coating materials was then processed through a 3 inch diameter rotary furnace under the conditions of Carrier Example III. The final product was comprised of a carrier core with a total of 0.2 percent polymer by weight on the surface with the sodium lauryl sulfate poly(methyl methacrylate) comprising 90 percent of the coating and carbon black comprising the other 10 percent by weight.

A developer composition was then prepared by the process of Carrier Example I. The developer was conditioned as described in Carrier Example I; the triboelectric charge on the carrier of 21.8 microcoulombs per gram. Further, the conductivity was $9.4\times10^{-8}$ (ohm-cm)$^{-1}$ as determined using the same process described in Carrier Example I.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. Carrier comprised of a core, a polymer coating, and wherein said coating contains a mixture of an alkali metal lauryl sulfate and a conductive component, and wherein said polymer is a polymethylmethacrylate, the alkali metal is sodium, the conductive component is carbon black, and at a polymer/alkali metal/carbon black ratio of from about 1 part to about 20 parts, and wherein the conductivity of said carrier is from about $10^{-15}$ to about $10^{-4}$.

2. A carrier in accordance with claim 1 wherein said ratio for said polymer, said sodium lauryl sulfate, and said carbon black is from about 79.5/0.5/20 to about 99.5/0.5/0, and wherein the conductivity of said carrier is from about $10^{-8}$ to about $10^{-6}$.

3. A carrier in accordance with claim 1 wherein said core diameter is from about 30 to about 130 microns, and optionally wherein said core is iron, steel or a ferrite.

4. A carrier in accordance with claim 2 with a triboelectric charge value of from about 15 to about 25 microcoulombs/gram and a conductivity of from about $10^{-12}$ to about $10^{-6}$ (ohm-cm)$^{-1}$.

5. A process for the preparation of carrier comprised of mixing carrier core with a mixture of monomer, alkali metal lauryl sulfate, conductive component, and initiator, optional chain transfer agent and optional crosslinking agent; polymerizing the monomer by heating thereby resulting in a polymer contained on the carrier core and the conductive component, and sulfate present in or on the carrier polymer coating, and wherein said monomer is selected from the group consisting of acrylic acid, methyl acrylate, ethyl acrylate, n-butyl acrylate, isobutyl acrylate, dodecyl acrylate, n-octyl acrylate, 2-chloroethyl acrylate, phenyl acrylate, methylalphachloracrylate, methacrylic acids, methyl methacrylate, ethyl methacrylate, butyl methacrylate, octyl methacrylate, acrylonitrile, methacrylonitrile and acrylamide; maleic acid, monobutyl maleate, dibutyl maleate; vinyl chloride, vinyl bromide, vinyl fluoride, vinyl acetate and vinyl benzoate; vinylidene chloride; pentafluoro styrene, allyl pentafluorobenzene, N-vinyl pyrrole, and trifluoroethyl methacrylate, and mixtures thereof; and wherein said monomer is present in an amount of from about 1 to about 5 percent by weight of said carrier core, or wherein said monomer is methyl methacrylate, styrene, trifluoroethyl methacrylate, or mixtures thereof, and wherein said monomer is present in an amount of from about 0.5 to about 10 percent by weight, or from about 1 to about 5 percent by weight of said carrier core and where the amount of said conductive component present is from about 10 to about 70 percent by weight, or from about 20 to about 50 percent by weight of said monomer mixture, and wherein said initiator is selected from the group consisting of azo compounds, peroxides, and mixtures thereof, and wherein the amount of said initiator is from about 0.1 to about 20 percent by weight, or from about 0.5 to about 10 percent by weight of said monomer mixture, and optionally wherein said initiator is selected from the group consisting of 2,2'-azodimethylvaleronitrile, 2,2'-azoisobutyronitrile, azobiscyclohexanenitrile, 2-methylbutyronitrile, benzoyl peroxides, lauryl peroxide, 1-1-(t-butylperoxy)-3,3,5-trimethyl cyclohexane, n-butyl-4, 4-di-(t-butylperoxy)valerate, dicumyl peroxide, and mixtures thereof.

6. A developer comprised of the carrier of claim 1 and toner.

7. A developer in accordance with claim 6 wherein said toner is comprised of a thermoplastic resin, colorant, and optionally, toner additives, and wherein said additives are charge additives, wax, surface additives and mixtures thereof.

8. Carrier particles comprised of a core, and thereover a polymer coating wherein said coating contains a mixture of an alkali metal lauryl sulfate and carbon black, wherein said alkali metal lauryl sulfate is sodium lauryl sulfate, and said polymer is polymethylmethacrylate, and wherein said polymer is present in an amount of about 0.6 percent by weight, and wherein the sodium lauryl sulfate polymethylmethacrylate comprises 95 percent of the coating, and said carbon black comprises about 5 percent of the coating.

* * * * *